US007407268B2

(12) United States Patent
Chen

(10) Patent No.: US 7,407,268 B2
(45) Date of Patent: Aug. 5, 2008

(54) CARTRIDGE ALIGNMENT MECHANISM AND METHOD THEREOF

(75) Inventor: Chih-Hung Chen, Tainan County (TW)

(73) Assignee: Qisda Corporation, Taoyuan (TW)

( * ) Notice: Subject to any disclaimer, the term of this patent is extended or adjusted under 35 U.S.C. 154(b) by 386 days.

(21) Appl. No.: 11/137,338

(22) Filed: May 26, 2005

(65) Prior Publication Data

US 2005/0270346 A1 Dec. 8, 2005

(30) Foreign Application Priority Data

Jun. 2, 2004 (TW) ..... 93115788 A

(51) Int. Cl.
*B41J 2/14* (2006.01)
*B41J 2/16* (2006.01)

(52) U.S. Cl. ..... 347/50; 347/50

(58) Field of Classification Search ..... 347/49, 347/50, 84–87, 37
See application file for complete search history.

(56) References Cited

U.S. PATENT DOCUMENTS

| | | | | |
|---|---|---|---|---|
| 4,907,018 | A | 3/1990 | Pinkerpell et al. | 347/87 |
| 5,392,063 | A | 2/1995 | Rhoads | 347/49 |
| 5,504,513 | A | 4/1996 | Nobel et al. | 347/87 |
| 5,629,725 | A | 5/1997 | Buican | 347/49 |
| 6,604,814 | B2 * | 8/2003 | Browning et al. | 347/50 |
| 2002/0163566 | A1 | 11/2002 | Jang et al. | 347/86 |

* cited by examiner

*Primary Examiner*—Juanita D Stephens
(74) *Attorney, Agent, or Firm*—Muncy, Geissler, Olds & Lowe, PLLC

(57) ABSTRACT

A cartridge alignment mechanism. A cartridge, detachably installed in a carriage, comprises an abutting surface symmetrical to a symmetrical plane and corresponding to an abutting datum surface, and first and second alignment surfaces respectively corresponding to first and second datum surfaces. The cartridge disposed in the carriage cause the first and second datum surfaces to abut the first and second alignment surfaces to align the cartridge in the Y and Z directions, and the abutting datum surface abuts the abutting surface in Z-direction to align the cartridge in X-direction.

15 Claims, 9 Drawing Sheets

10

40'

CARTRIDGE ALIGNMENT MECHANISM AND METHOD THEREOF

BACKGROUND

The present invention relates to a cartridge alignment mechanism, and more particularly to a cartridge alignment mechanism for use in business machines such as inkjet printers.

In inkjet printing, a cartridge contains ink, and a printhead is mounted on one end of the cartridge, connected with the reservoir. The cartridge is detachably mounted on a carriage, adapted to move bidirectionally above a media sheet. When the cartridge is mounted on the carriage, it is necessary to maintain lock-in and alignment.

Single-sided alignment is generally applied in cartridge alignment. In this case, a biasing force is provided against the cartridge, forcing the cartridge to lock and remain in a single side thereof. For example, U.S. Pat. No. 4,907,018 discloses a printhead cartridge and carriage assembly in which a force loading spring pad abuts a portion of the cartridge. U.S. Pat. No. 5,392,063 discloses a unitary latch assembly, in which each latch end is provided with a cam of a low friction material in the form of a horizontal section of an inclined cylinder to abut four cartridges.

Since the biasing force is not symmetrical, however, the cartridges disclosed in U.S. Pat. Nos. 5,392,063 and 4,907,018 may tilt in alignment. In U.S. Pat. No. 5,392,063, the cam is of a low friction material to reduce biasing due to friction. It is impossible, however, to completely eliminate friction between the cam and the cartridge.

Further, in U.S. Pat. No. 4,907,018, a leaf spring is applied to abut the sidewall of the cartridge. Accordingly, the sidewall is deformed. In this case, U.S. Pat. No. 5,504,513 discloses a compensated structure of the side wall for the cartridge to reduce deformation thereof. Nonetheless, deformation is not totally eliminated.

SUMMARY

In an embodiment of the present invention, a cartridge alignment mechanism comprises a carriage, a holding device and a cartridge. The carriage comprises a first datum surface perpendicular to a first or Y-direction, a second datum surface perpendicular to a second or Z-direction, and a first guide portion movable in the second direction. A symmetrical plane is formed in the Y-Z plane. The holding device comprises an abutting datum surface symmetrical to the symmetrical plane and a second guide portion corresponding to the first guide portion, the second guide portion movable in relation to the first guide portion to move the abutting datum surface in the second direction toward the carriage. The cartridge, detachably installed in the carriage, comprises an abutting surface symmetrical to the symmetrical plane and corresponding to the abutting datum surface, a first alignment surface corresponding to the first datum surface, and a second alignment surface corresponding to the second datum surface. When in the carriage, the first and second datum surfaces of the cartridge abut the first and second alignment surfaces to align the cartridge in Y and Z directions, and the abutting datum surface abuts the abutting surface in Z-direction to align the cartridge in a third or X-direction.

The holding device can also comprise a guide latch and a compression spring. The guide latch comprises the abutting datum surface and the second guide portion, and the compression spring is disposed between the carriage and the guide latch to abut the guide latch against the cartridge in the second direction.

A method of cartridge alignment is also disclosed. A carriage and a cartridge as mentioned above are provided. The cartridge is disposed in the carriage so that the first datum surface abuts the first alignment surface to align the cartridge in the first direction and the second datum surface abuts the second alignment surface to align the cartridge in the second direction. Then, an abutting force abuts the abutting surface in the second direction to align the cartridge in a third direction perpendicular to the symmetrical plane.

The abutting datum surface can be a low friction surface to further reduce the possibility of cartridge tilt. Further, the second datum surface and the second alignment surface can be rough surfaces so that friction in the second direction secures the cartridge lock-in.

A printhead may be disposed on an end of the cartridge opposite to the abutting surface. Further, the cartridge may have an electrical interconnection device disposed on a side of the cartridge facing the carriage for conveying electrical control signals of the cartridge.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION

Figure 1:
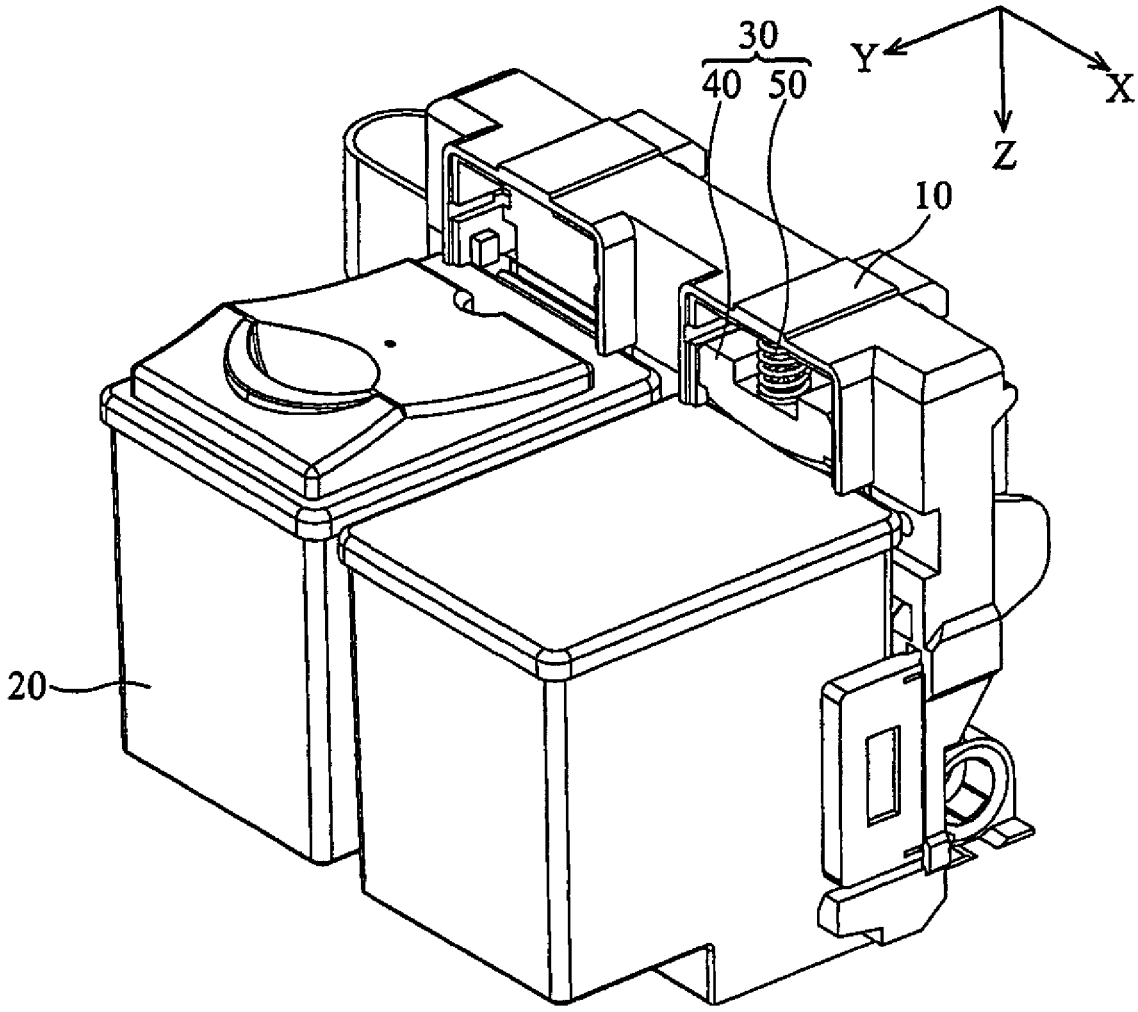
FIG. 1 is a perspective view of a cartridge alignment mechanism of an embodiment of the present invention.

In FIG. 1, a cartridge alignment mechanism comprises a carriage 10, a cartridge 20 and a holding device 30.

Specifically, the holding device 30 comprises a guide latch 40 and a compression spring 50. A reference three-dimensional X-Y-Z coordinate is shown in FIG. 1, in which Y-direction refers to a first direction, Z-direction refers to a second direction, and X-direction refers to a third direction.

Figure 2A:
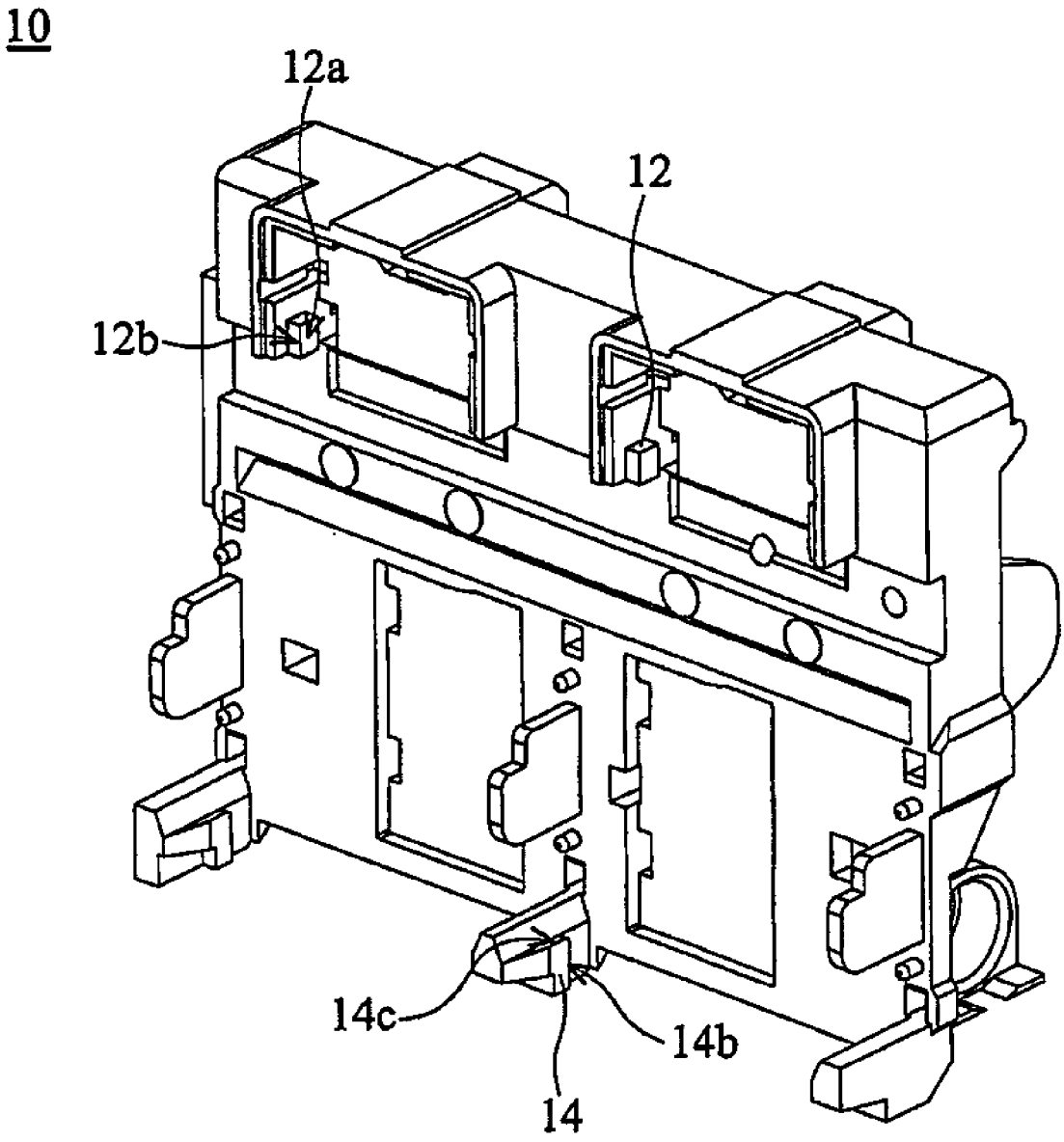
FIG. 2A is a perspective view of the carriage in FIG. 1.
Figure 2B:
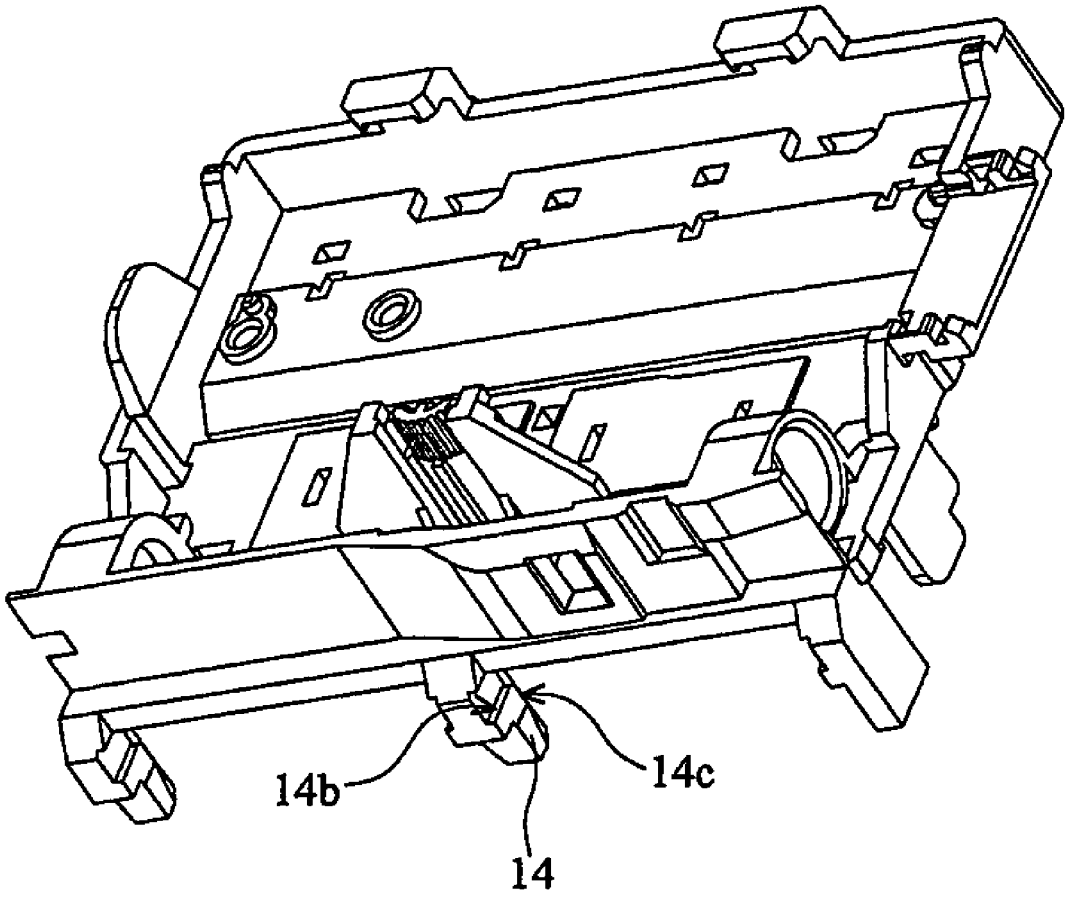
FIG. 2B is another perspective view of the carriage in FIG. 2A.

FIGS. 2A and 2B show the carriage 10 in detail. The carriage 10 comprises a first guide portion 12 movable in Z-direction, and a datum portion 14 for alignment. The datum portion 14 is an L-shaped extrusion and comprises a first datum surface 14*b* perpendicular to Y-direction and a second datum surface 14*c* perpendicular to Z-direction. The first guide portion 12 is an extrusion engaged to the holding device to be movable in Z-direction and has an X surface 12*a* and a Y surface 12*b*. A symmetrical plane of the carriage 10 is formed along the Y-Z plane.

Figure 3A:
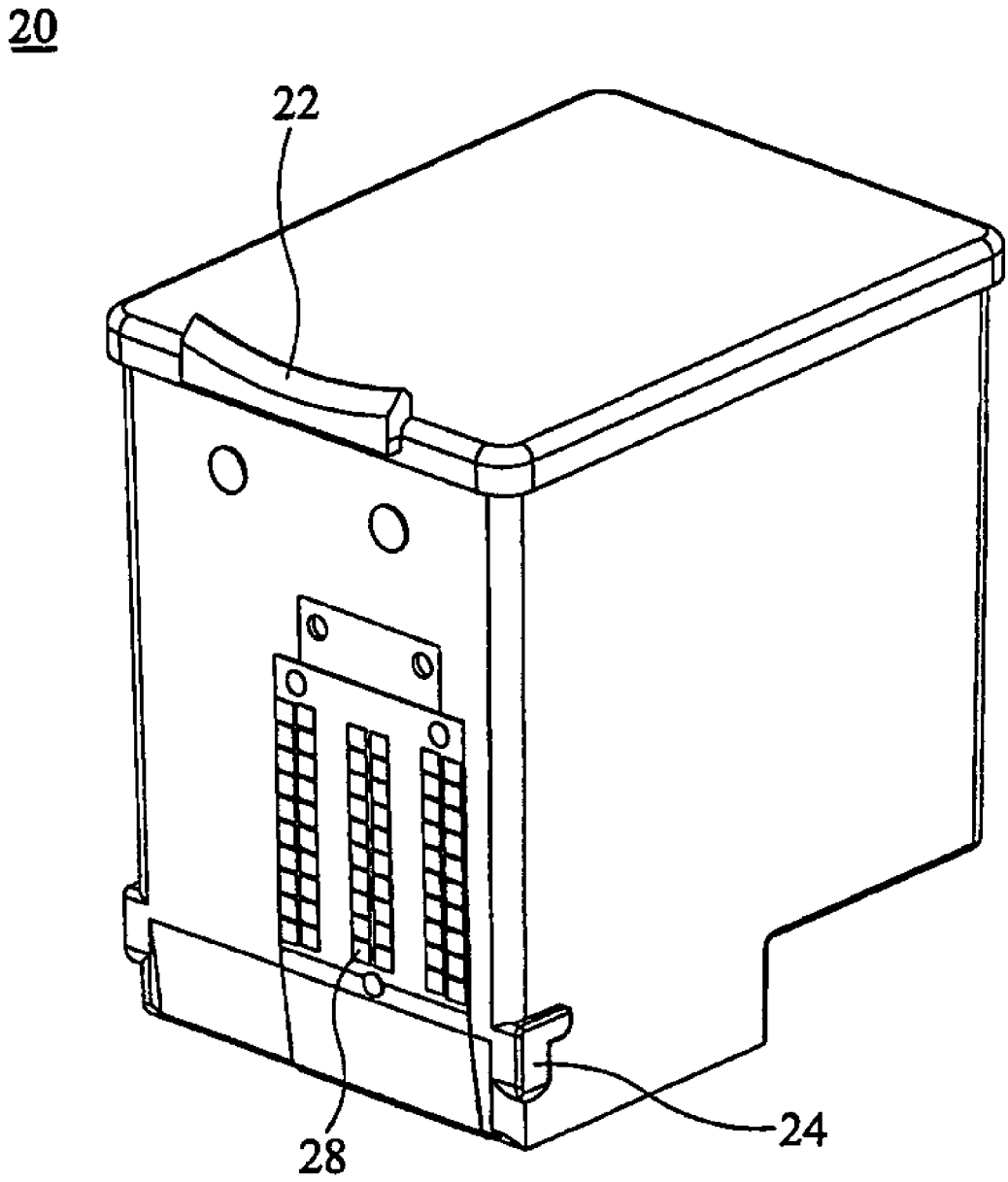
FIG. 3A is a perspective view of the cartridge in FIG. 1.
Figure 3B:
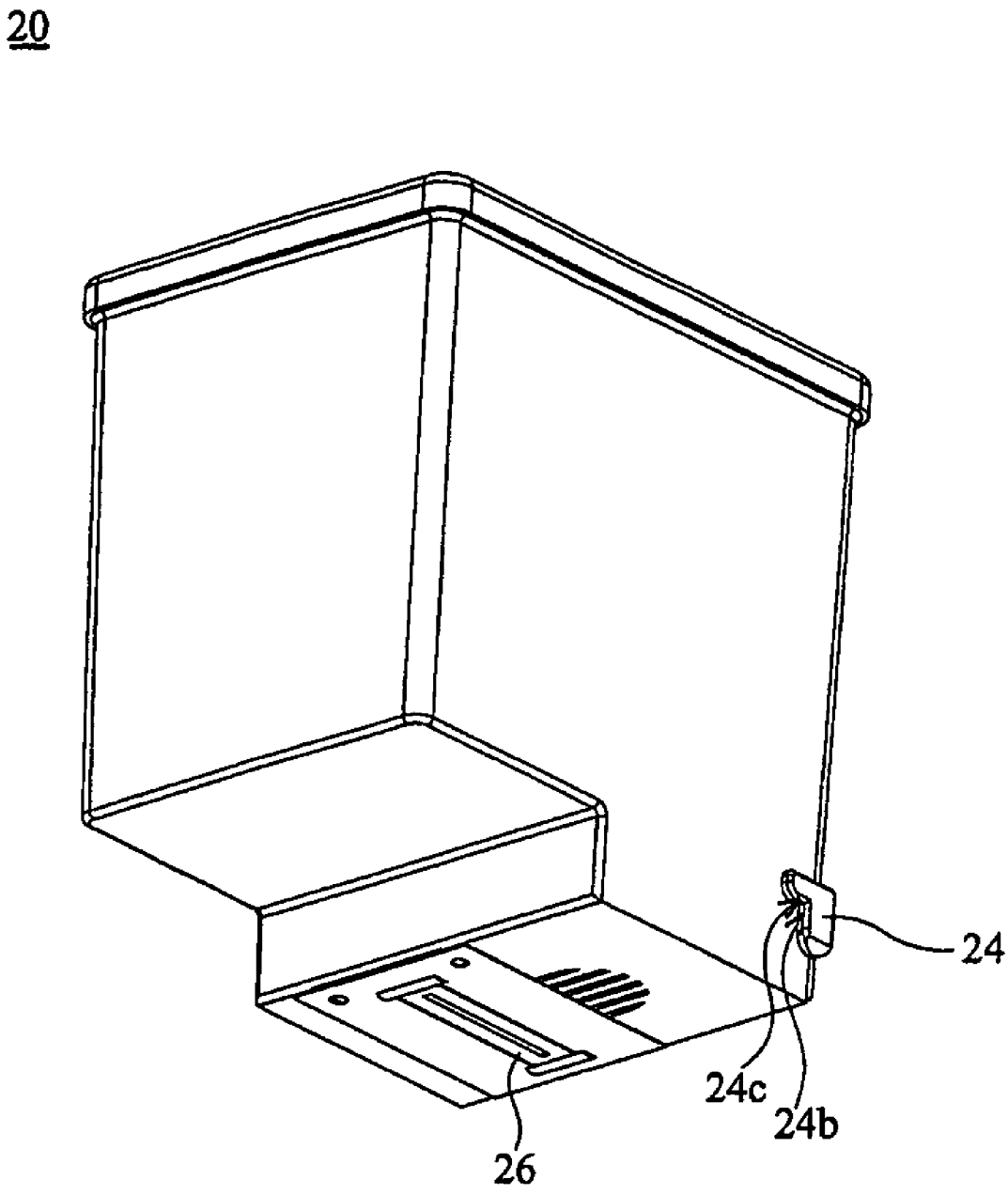
FIG. 3B is another perspective view of the cartridge in FIG. 3A.

FIGS. 3A and 3B show the cartridge 20 in detail. The cartridge 20, detachably installed in the carriage 10, comprises an abutting surface 22 symmetrical to the symmetrical plane and an alignment portion 24 corresponding to the datum portion 14. The alignment portion 24 comprises a first alignment surface 24*b* corresponding to the first datum surface 14*b*, and a second alignment surface 24*c* corresponding to the second datum surface 14*c*. Further, an electrical interconnection device 28 is disposed on a side of the cartridge 20 facing the carriage 10 for conveying electrical control signals of the cartridge 20. The electrical interconnection device 28 comprises a flexible printed circuit board to convey the electrical control signals. A spring can be disposed between the carriage 10 and the electrical interconnection device 28 to abut the flexible printed circuit board against the carriage 10 for stabilized interconnection.

The abutting surface 22 is a curved surface symmetrical to the symmetrical plane as shown in FIG. 3A. A non-flat surface can alternatively be employed as the abutting surface 22. The alignment portion 24 is disposed on both sides of the cartridge 20 and is L-shaped, similar to the datum portion 14. Further, a printhead 26 is disposed on an end of the cartridge 20 opposite the abutting surface 22, i.e. the bottom side as shown in FIG. 3B.

The holding device 30 comprises guide latch 40 and compression spring 50. The compression spring 50 is disposed between the carriage 10 and the guide latch 40 to abut the guide latch 40 against the cartridge 20 in Z-direction.

Figure 4A:
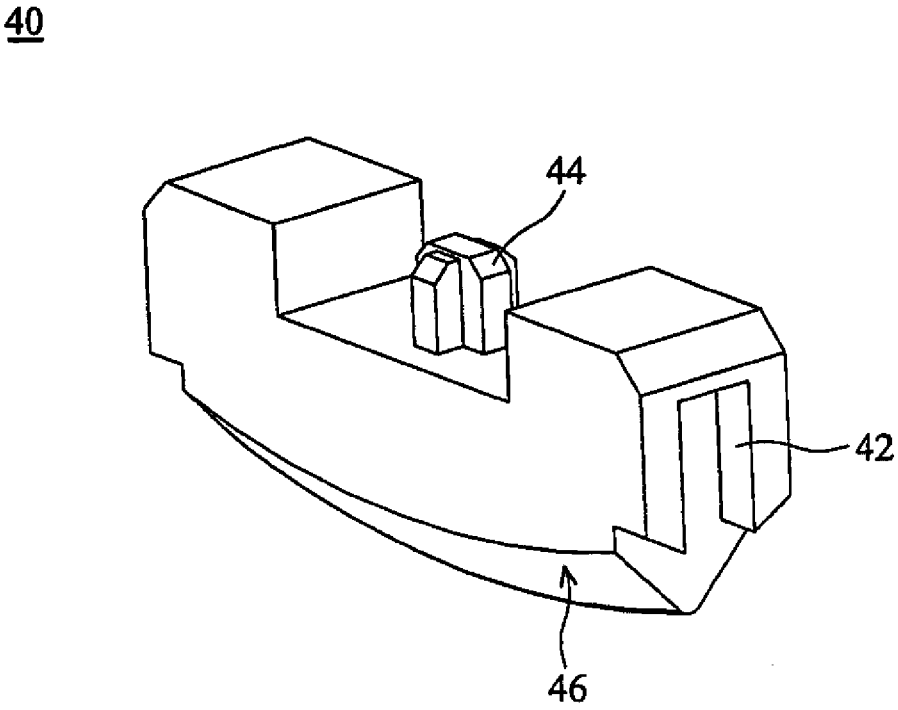
FIG. 4A is a perspective view of the guide latch in FIG. 1.
Figure 4B:
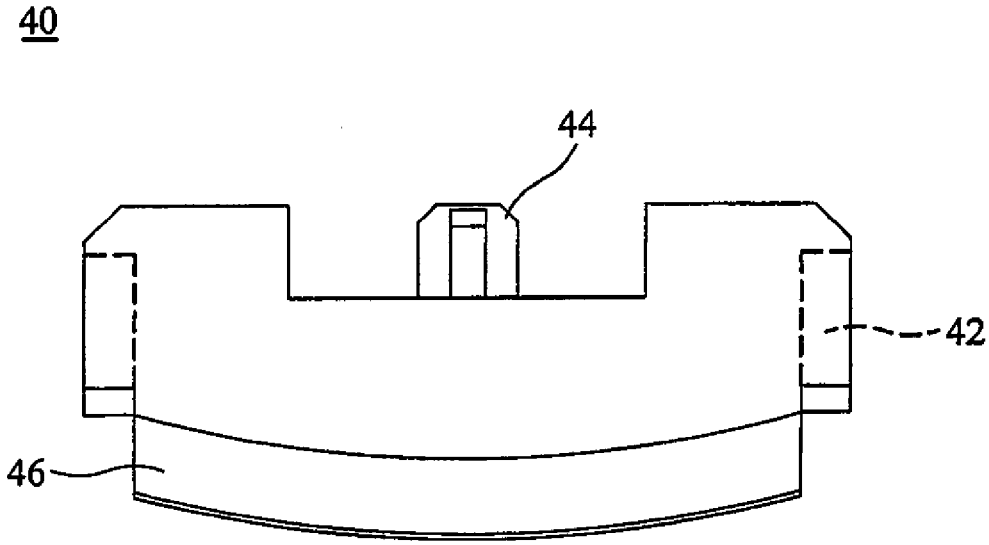
FIG. 4B is a front view of the guide latch in FIG. 4A.
Figure 4C:
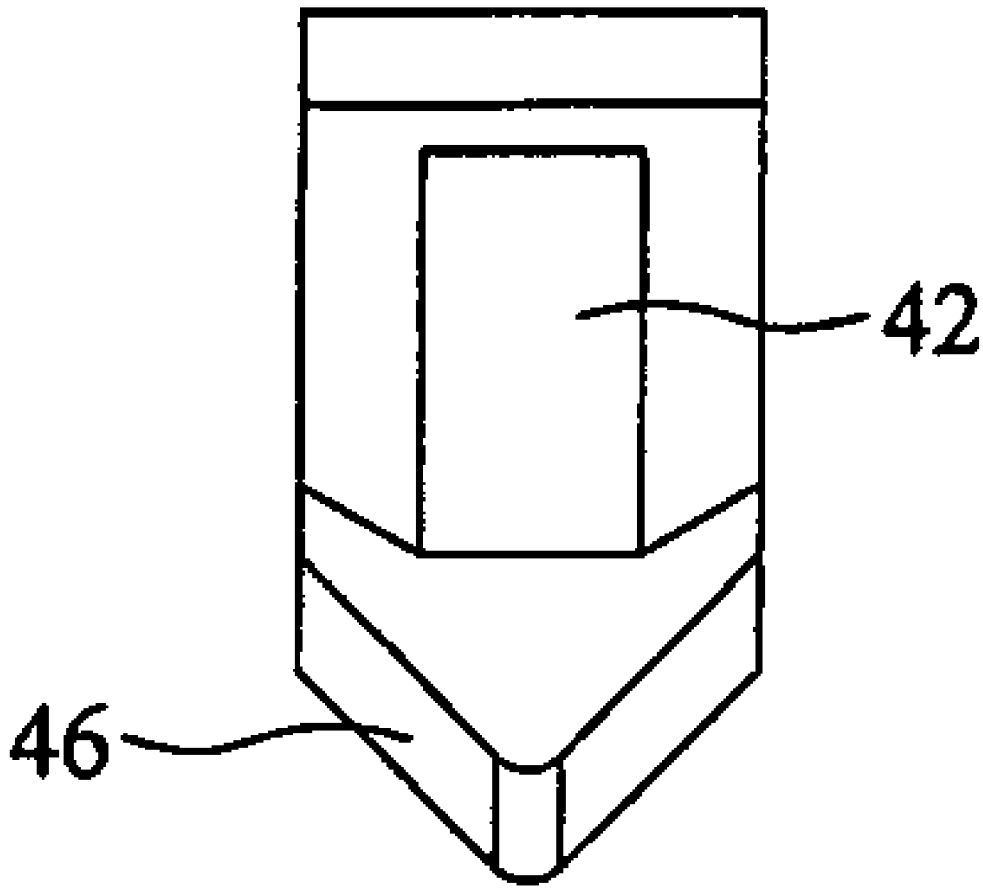
FIG. 4C is a side view of the guide latch in FIG. 4A.

The guide latch 40 can be facilitated in a variety of structures. For example, FIGS. 4A, 4B and 4C show guide latch 40 comprising a second guide portion 42 corresponding to the first guide portion 12, a spring engaging portion 44 engaged to the compression spring 50, and an abutting datum surface 46 symmetrical to the symmetrical plane and corresponding to the abutting surface 22. The second guide portion 42 is a guide slot movable in relation to the first guide portion 12 to move the abutting datum surface 46 in Z-direction toward the cartridge 20. Thus, the compression spring 50 abuts the guide latch 40 against the cartridge 20 in Z-direction.

Figure 5A:
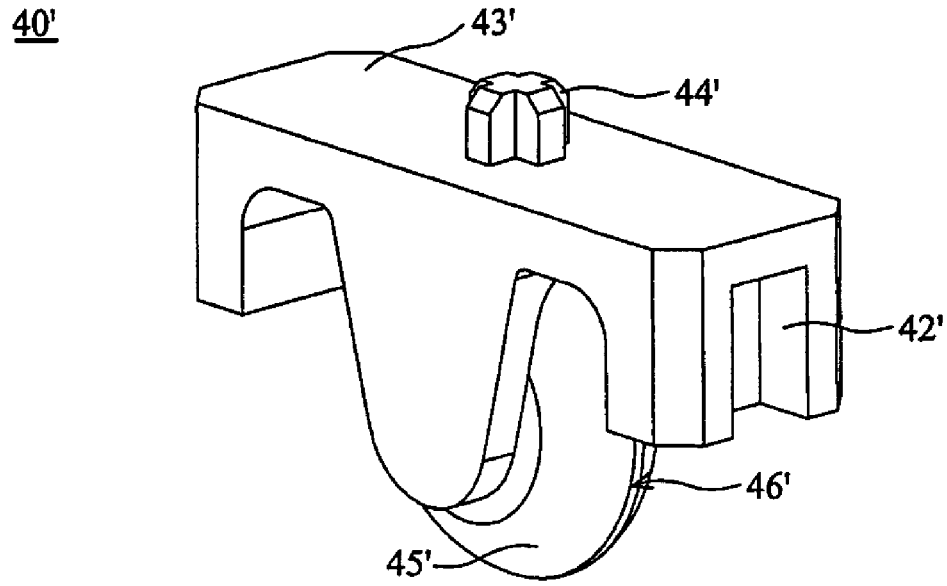
FIG. 5A is a perspective view of another guide latch.
Figure 5B:
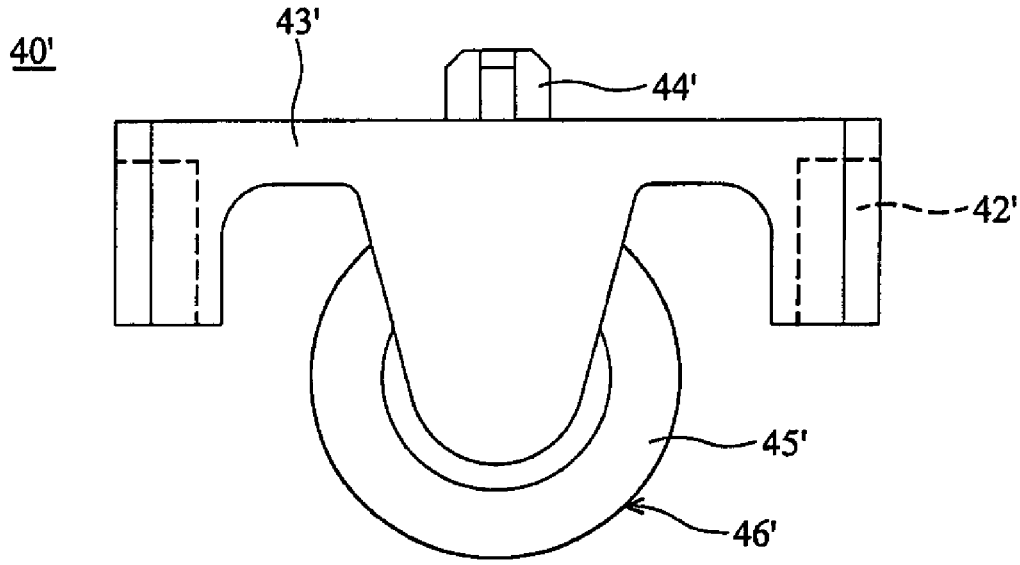
FIG. 5B is a front view of the guide latch in FIG. 5A.
Figure 5C:
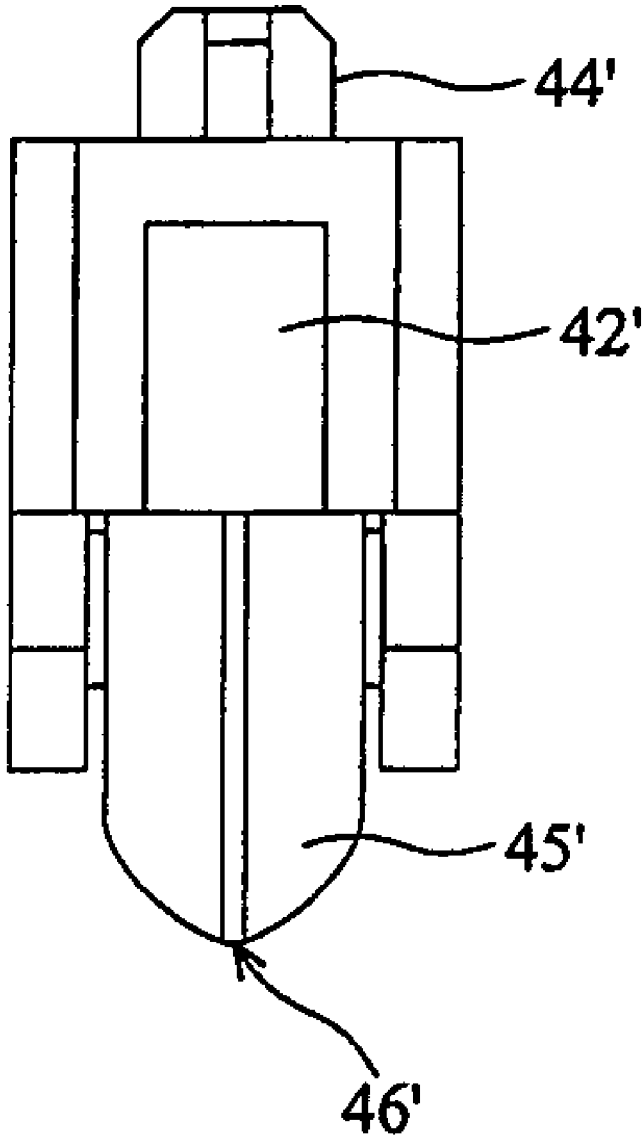
FIG. 5C is a side view of the guide latch in FIG. 5A.

FIGS. 5A, 5B and 5C show a guide latch 40', in which a guide base 43' and a rotor 45' are provided. The guide base 43' is provided with second guide portion 42', essentially the same structure as second guide portion 42 in FIGS. 4A and 4C. The rotor 45' is rotatable in X-direction, and a peripheral surface of the rotor 45' acts as the abutting datum surface 46'. Thus, the abutting datum surface 46' is a curved peripheral surface corresponding to the abutting surface 22. Thus, the compression spring 50 abuts the guide latch 40' against the cartridge 20 in Z-direction.

A method of cartridge alignment according to an embodiment of the present invention is hereinafter described in detail. A carriage 10 and a cartridge 20 as shown in FIG. 1 are provided. The carriage 10 comprises a first guide portion 12 movable in Z-direction, and a datum portion 14 for alignment. The datum portion 14 is an L-shaped extrusion and comprises a first datum surface 14*b* perpendicular to Y-direction and a second datum surface 14*c* perpendicular to Z-direction. The first guide portion 12 is an extrusion engaged to the holding device to be movable in Z-direction and has an X surface 12*a* and a Y surface 12*b*. A symmetrical plane of the carriage 10 is formed in the Y-Z plane. The cartridge 20 has an abutting surface 22 symmetrical to the symmetrical plane and an alignment portion 24 corresponding to the datum portion 14. The alignment portion 24 has a first alignment surface 24*b* corresponding to the first datum surface 14*b*, and a second alignment surface 24*c* corresponding to the second datum surface 14*c*.

Cartridge 20 is disposed in the carriage 10 so that the first datum surface 14*b* abuts the first alignment surface 24*b* to align the cartridge 20 in Y-direction, and the second datum surface 14*c* abuts the second alignment surface 24*c* to align the cartridge 20 in Z-direction. An abutting force is provided by the compression spring 50 to abut the abutting datum surface 46 of the guide latch 40 against the abutting surface 22 in Z-direction. Since the abutting surface 22 is not flat, the distribution of the abutting force is symmetrical in X-direction to align the cartridge 20 in X-direction. Thus, the cartridge 20 is secured in a balanced position with equal force and torque.

It should be mentioned that, although the low friction material disclosed in U.S. Pat. No. 5,392,063 does not totally eliminate friction, it is applicable in the abutting datum surface 46 of the embodiment to further reduce the possibility of tilting.

Further, the second datum surface 14*c* and the second alignment surface 24*c* may comprise rough surfaces, whereby friction is obtained in Z-direction to secure the cartridge 20 without damage. The friction also maintains the equilibrium of force and torque in X-direction since the force points of the cartridge 20 are not collinear.

The abutting datum surface 46 can provide compensated torque to the cartridge 20, such that equilibrium of force and torque of the cartridge 20 is further secured.

While the invention has been described by way of example and in terms of preferred embodiment, it is to be understood that the invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A cartridge alignment mechanism, comprising:

a carriage comprising a first datum surface perpendicular to a first direction, a second datum surface perpendicular to a second direction substantially perpendicular to the first direction, and a first guide portion movable in the second direction, wherein the first direction and the second direction form a symmetrical plane, and the first guide portion is an extrusion;

a holding device comprising an abutting datum surface symmetrical to the symmetrical plane and a second guide portion corresponding to the first guide portion, wherein the second guide portion is a guide slot moving in relation to the first guide portion to move the abutting datum surface in the second direction toward the carriage; and a cartridge detachably installed in the carriage, the cartridge comprising an abutting surface symmetrical to the symmetrical plane and corresponding to the abutting datum surface, a first alignment surface corresponding to the first datum surface, and a second alignment surface corresponding to the second datum surface;

wherein, when the cartridge disposed in the carriage, the first datum surface abuts the first alignment surface to align the cartridge in the first direction, the second datum surface abuts the second alignment surface to align the cartridge in the second direction, and the abutting datum surface abuts the abutting surface in the second direction to align the cartridge in a third direction perpendicular to the symmetrical plane.

2. The cartridge alignment mechanism as claimed in claim 1, wherein the abutting datum surface is a low-friction surface.

3. The cartridge alignment mechanism as claimed in claim 1, wherein the second datum surface and the second alignment surface are rough surfaces.

4. The cartridge alignment mechanism as claimed in claim 1, wherein the cartridge comprises a printhead disposed to an end opposite to the abutting surface.

5. The cartridge alignment mechanism as claimed in claim 1, wherein the cartridge comprises an electrical interconnection device disposed on a side of the cartridge facing the carriage.

6. The cartridge alignment mechanism as claimed in claim 1, wherein the holding device has a compression spring abutting the abutting datum surface to the abutting surface in the second direction.

7. A cartridge alignment mechanism, comprising:

a carriage comprising a first datum surface perpendicular to a first direction, a second datum surface perpendicular to a second direction substantially perpendicular to the first direction, and a first guide portion movable in the second direction, wherein the first direction and the second direction form a symmetrical plane;

a guide latch having an abutting datum surface symmetrical to the symmetrical plane and a second guide portion corresponding to the first guide portion, the second portion moving in relation to the first guide portion to move the abutting datum surface in the second direction toward the carriage, wherein the guide latch comprises a guide base with the second guide portion, and a rotor rotatable in the first direction, a peripheral surface of the rotor forming the abutting datum surface; and a cartridge detachably installed in the carriage, the cartridge comprising an abutting surface symmetrical to the symmetrical plane and corresponding to the abutting datum surface, a first alignment surface corresponding to the first datum surface, and a second alignment surface corresponding to the second datum surface;

a compression spring disposed between the carriage and guide latch to abut the guide latch against the cartridge in the second direction;

wherein, when the cartridge disposed in the carriage, the first datum surface abuts the first alignment surface to align the cartridge in the first direction, the second datum surface abuts the second alignment surface to align the cartridge in the second direction, and the abutting datum surface abuts the abutting surface in the second direction to align the cartridge in a third direction perpendicular to the symmetrical plane.

8. The cartridge alignment mechanism as claimed in claim 7, wherein the abutting datum surface is a low-friction surface.

9. The cartridge alignment mechanism as claimed in claim 7, wherein the second datum surface and the second alignment surface are rough surfaces.

10. The cartridge alignment mechanism as claimed in claim 7, wherein the cartridge comprises a printhead disposed on an end opposite to the abutting surface.

11. The cartridge alignment mechanism as claimed in claim 7, wherein the cartridge comprises an electrical interconnection device disposed on a side of the cartridge facing the carriage.

12. A method of cartridge alignment, comprising:

providing a carriage comprising a first datum surface perpendicular to a first direction, a second datum surface perpendicular to a second direction substantially perpendicular to a second direction substantially perpendicular to the first direction, and a first guide portion movable in the second direction, wherein the first direction and the second direction form a symmetrical plane;

providing a cartridge comprising an abutting surface symmetrical to the symmetrical plane and corresponding to the abutting datum surface, a first alignment surface corresponding to the first datum surface, and a second alignment surface corresponding to the second datum surface, wherein the abutting surface is a non-flat surface;

disposing the cartridge in the carriage such that the first datum surface abuts the first alignment surface to align the cartridge in the first direction and the second datum surface abuts the second alignment surface to align the cartridge in the second direction;

abutting the abutting surface in the second direction to align the cartridge in a third direction perpendicular to the symmetrical plane.

13. The method of cartridge alignment as claimed in claim 12, further comprising providing a guide latch having an abutting datum surface symmetrical to the symmetrical plane and movable in the second direction toward the carriage to abut the abutting surface.

14. The method of cartridge alignment as claimed in claim 13, wherein the abutting datum surface is a low-friction surface.

15. The method of cartridge alignment as claimed in claim 12, wherein the second datum surface and the second alignment surface are rough surfaces.

* * * * *